US005881740A

United States Patent [19]

Lehmann

[11] Patent Number: 5,881,740

[45] Date of Patent: Mar. 16, 1999

[54] HAIR CURLING DEVICE AND METHOD OF USE

[76] Inventor: Roger W. Lehmann, 808 Ashley Ave., Brielle, N.J. 08730

[21] Appl. No.: 831,168

[22] Filed: Apr. 2, 1997

[51] Int. Cl.[6] ..... A45D 2/12; A45D 2/14; A45D 6/14

[52] U.S. Cl. ..... 132/255; 132/254; 132/245; 132/249

[58] Field of Search ..... 132/255, 254, 132/253, 245, 226, 223, 224, 112; 446/296, 268, 472, 319, 312, 394; 428/364; 434/262, 268, 94

[56] References Cited

U.S. PATENT DOCUMENTS

| | | | |
|---|---|---|---|
| 2,492,211 | 12/1949 | Curtis | 132/255 |
| 2,708,941 | 5/1955 | Field, Sr. | 132/255 |
| 2,757,676 | 8/1956 | Hamilton | 132/253 |
| 3,987,805 | 10/1976 | Schuster . | |
| 4,022,226 | 5/1977 | Muenstermann . | |
| 4,056,109 | 11/1977 | Takai | 132/253 |
| 4,381,791 | 5/1983 | Van Sickle | 132/253 |
| 4,533,328 | 8/1985 | McDaniel | 434/94 |
| 4,577,647 | 3/1986 | Fenster et al. . | |
| 4,630,622 | 12/1986 | Foreman | 132/253 |
| 4,884,583 | 12/1989 | Long, Jr. | 132/238 |
| 4,942,892 | 7/1990 | Hill | 132/247 |
| 5,460,190 | 10/1995 | Bondick . | |
| 5,515,874 | 5/1996 | Denebeim | 132/226 |
| 5,558,107 | 9/1996 | Kim . | |

*Primary Examiner*—Gene Mancene
*Assistant Examiner*—Pedro Philogene
*Attorney, Agent, or Firm*—Caesar, Rivise, Bernstein, Cohen & Pokotilow, Ltd.

[57] ABSTRACT

A curler and a method of use for curling hair, e.g., the synthetic hair of a doll. The curler has an elongated rod, an elongated pressure applicator, and pivotable connector enabling the rod to be pivoted from an open position wherein it is located spaced from the pressure applicator to a closed position wherein it is located closely parallel to the pressure applicator. The rod is of very small diameter arranged to have a hank of the hair of the doll wrapped in a tight spiral about it. The pressure applicator is an elongated member having a hair engaging surface formed of a compressible resilient foam which, when the rod is in the closed position, applies pressure to the portion of the hank of hair disposed between it and said rod. This action causes the hair to take a curl without the necessity of the application of heat thereto. The curler also includes a catch member for releasable holding the rod in the closed position. The curler can be formed of plastic, metal or a combination of both.

22 Claims, 4 Drawing Sheets

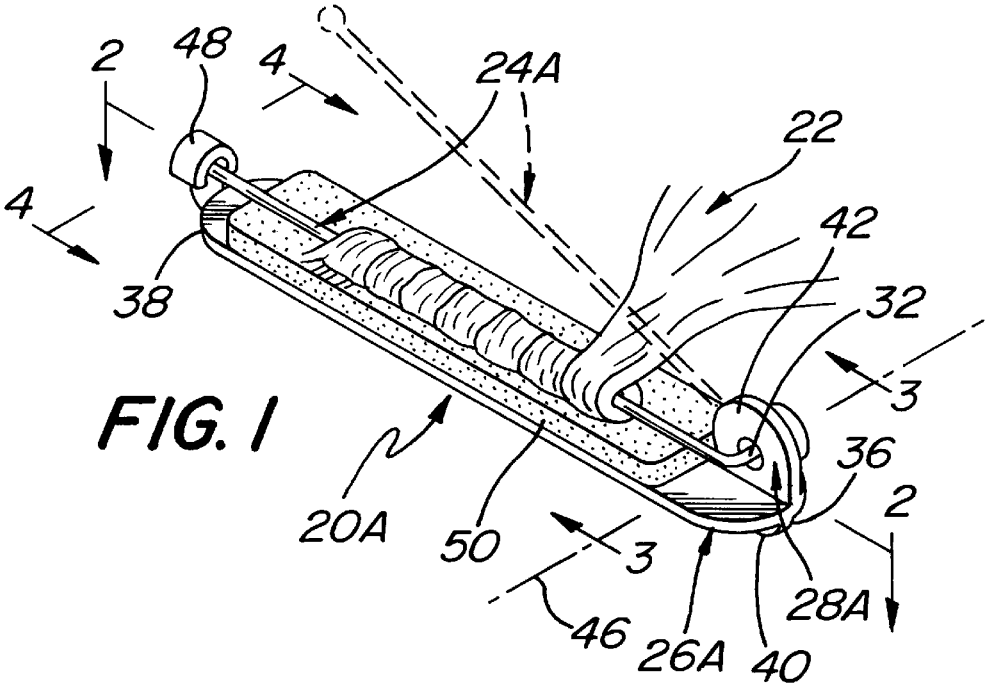
FIG. 1
FIG. 2
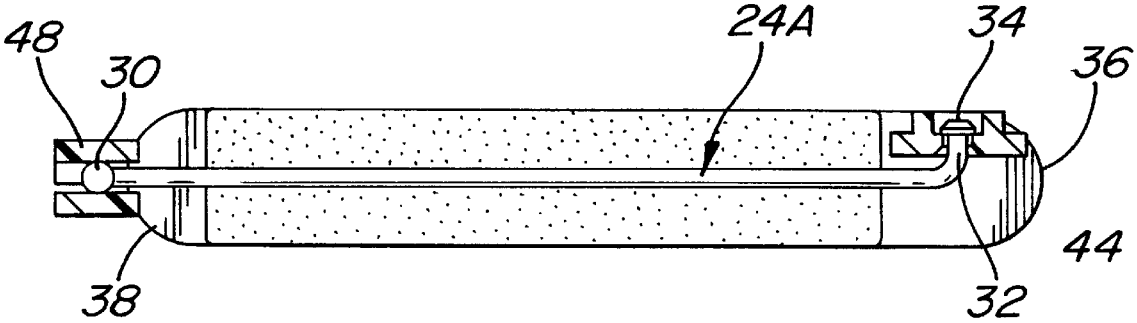
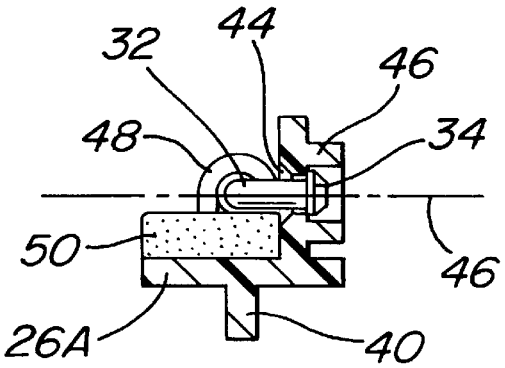
FIG. 3
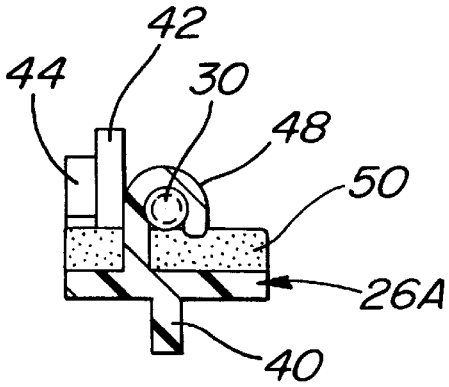
FIG. 4

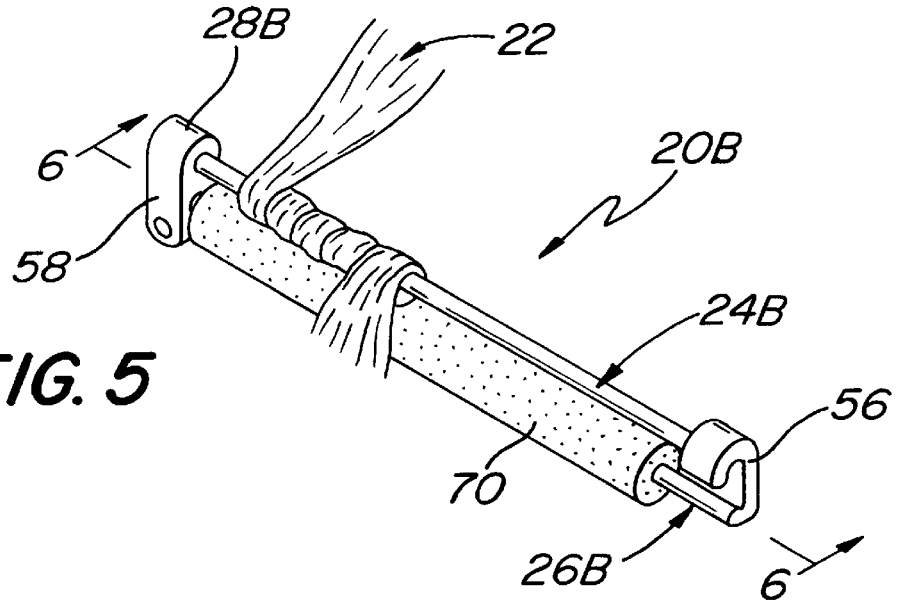
FIG. 5
FIG. 6
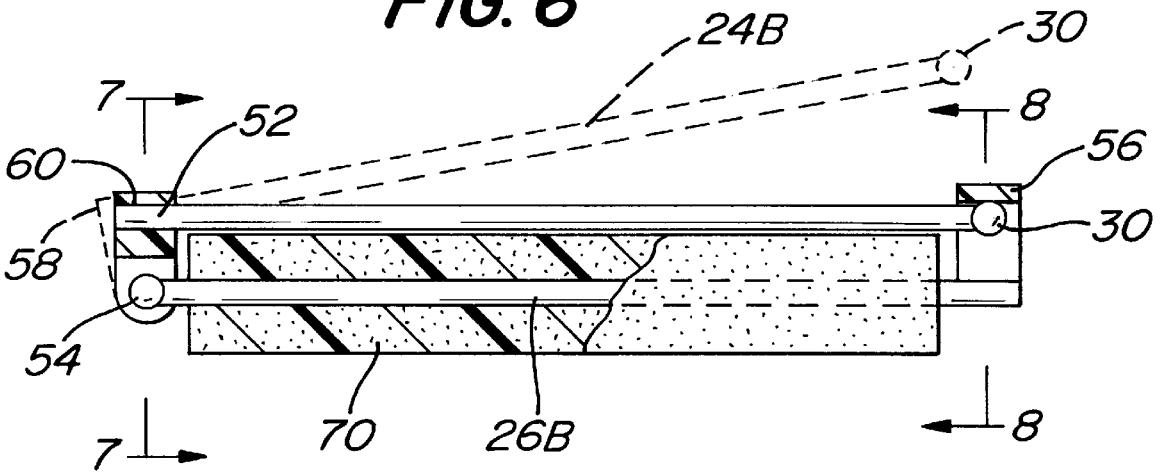
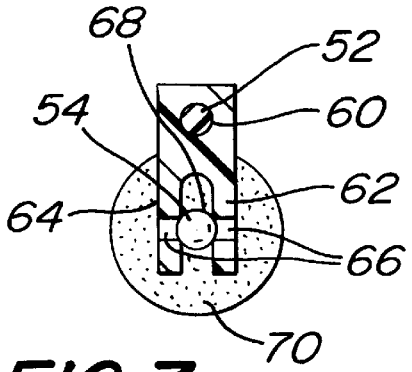
FIG. 7
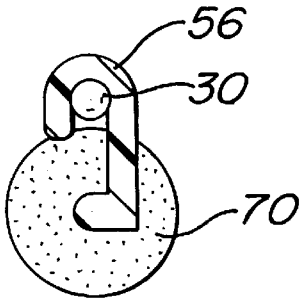
FIG. 8

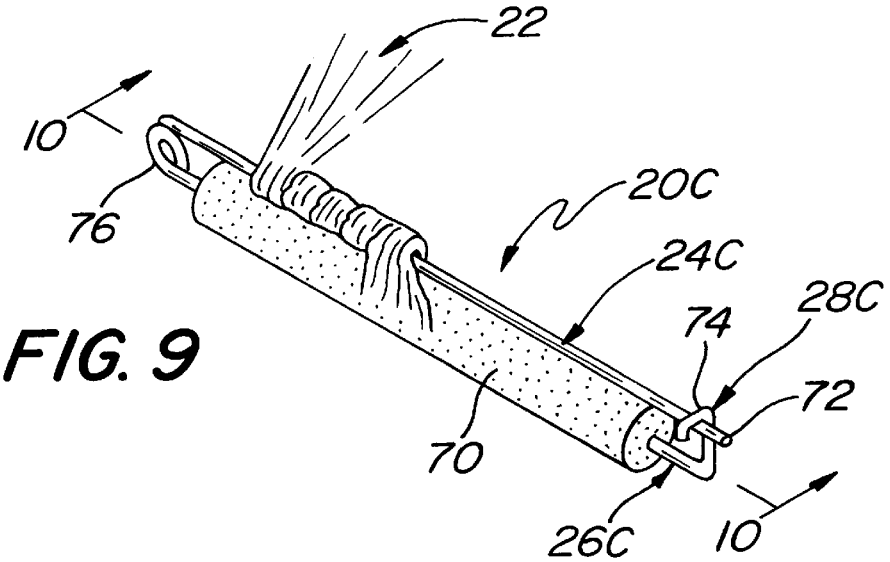
FIG. 9
FIG. 10
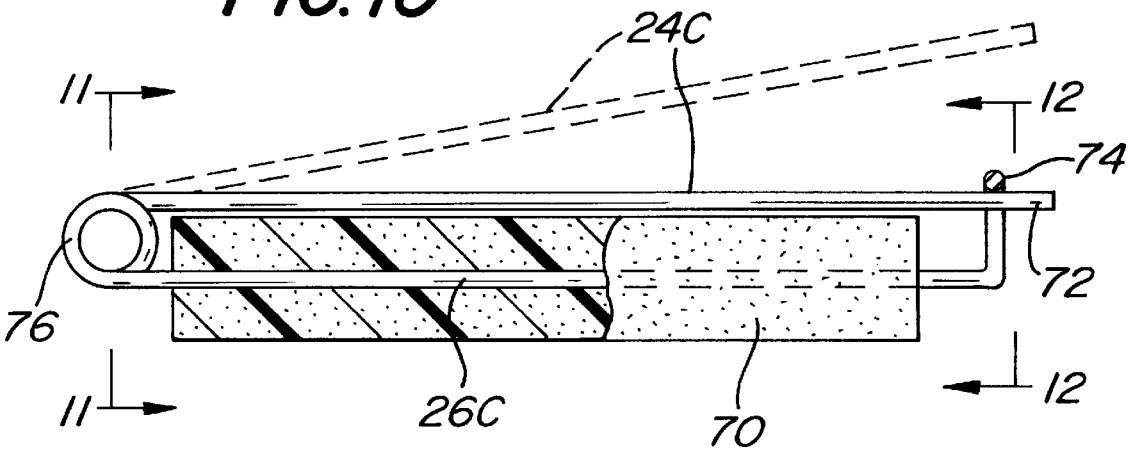
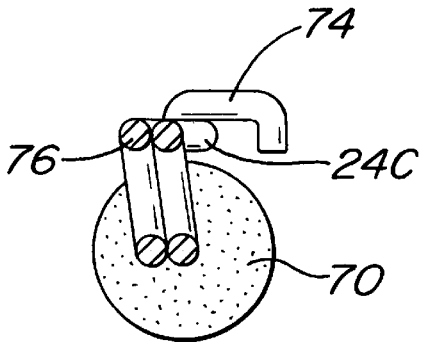
FIG. 11
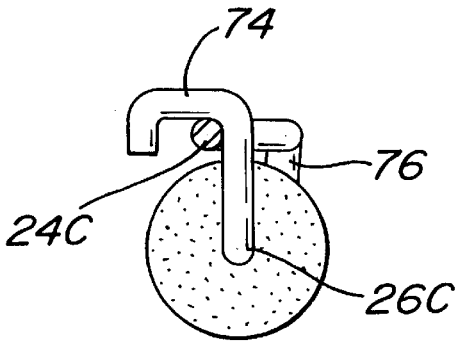
FIG. 12

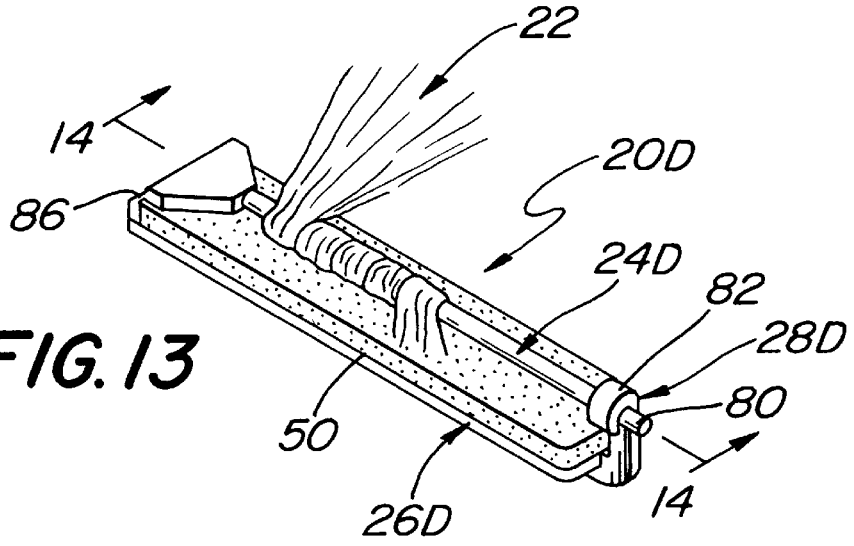
FIG. 13
FIG. 14
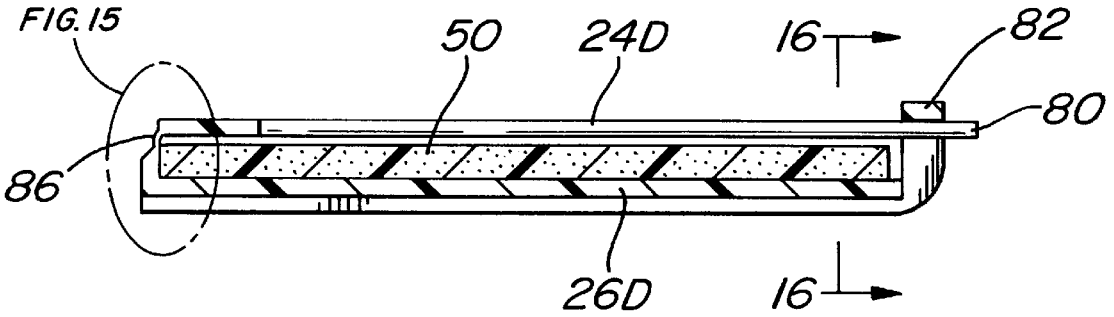
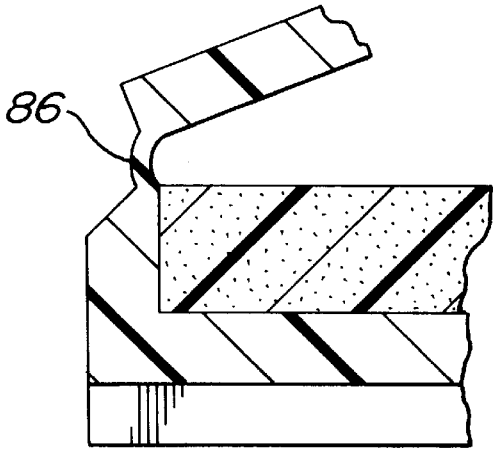
FIG. 15
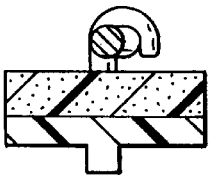
FIG. 16

HAIR CURLING DEVICE AND METHOD OF USE

FIELD OF THE INVENTION

The invention relates generally to toys and more specifically to devices to enable children to curl the hair on dolls without the necessity of using heat or steam.

Various types of hair curlers are commercially available and many are disclosed in the patent literature. Examples of prior art hair curlers are found in the following U.S. Pat. Nos. 3,987,805 (Schuster), 4,022,226 (Muenstermann), 4,575,647 (Fenster et al.), 5,460,190 (Bondick), and 5,558,107 (Kim).

The prior art curlers do not appear suitable for use by children to curl the hair of dolls or their own hair. For example, some of the aforementioned patented curlers require the application of heat or steam, an obviously undesirable limitation where young children are concerned. Moreover, even if heat or steam is not required the construction of the prior art curlers is such that they would not be effective to produce a curl on synthetic doll hair since they do not permit the formation of a very tight small spiral and the clamping of the spiral for a sufficient time necessary to set the curl.

Thus, a need exists to provide a curler which can be used by children to produce curls in the hair of dolls without the application of heat or steam.

SUMMARY OF THE INVENTION

The subject invention addresses that need by providing a curler and a method of use for curling hair, such as that of a doll or of a person. The curler comprises an elongated rod, a pressure applicator, and pivotable connecting means. The elongated rod is of very small diameter, e.g., approximately 0.125 inch (3.2 mm), and is arranged to have a hank of the hair of the doll wrapped in a tight spiral configuration along at least a portion of its length. The pressure applicator is also an elongated member, and has a hair engaging surface. That surface is formed of a resilient, compressible material, e.g., a strip or tube of foam. The elongated rod is pivotally connected to the pressure applicator by the pivotable connecting means, e.g., a hinge, whereupon the rod may be releasably disposed in a closed position closely parallel to the hair engaging surface of the pressure applicator. That surface is arranged to apply pressure to the portion of the hank of hair disposed between it and the rod when the rod is in the closed position, to thereby cause the hair to take a curl without the necessity of the application of heat or steam.

In accordance with one aspect of the method water or some other curl setting medium can be applied to the spirally wrapped hank of hair while it is on the rod to facilitate the formation of the curl.

DESCRIPTION OF THE DRAWING

Other objects and many attendant features of this invention will become readily appreciated as the same becomes better understood by reference to the following detailed description when considered in connection with the accompanying drawing wherein:

FIG. 1 is an isometric view of one embodiment of a doll hair curler constructed in accordance with this invention;

FIG. 2 is an enlarged sectional view taken along line 2—2 of FIG. 1;

FIG. 3 is an enlarged sectional view taken along line 3—3 of FIG. 1;

FIG. 4 is an enlarged sectional view taken along line 4—4 of FIG. 1;

FIG. 5 is an isometric view of another embodiment of a doll hair curler constructed in accordance with this invention;

FIG. 6 is an enlarged sectional view taken along line 6—6 of FIG. 5;

FIG. 7 is a sectional view taken along line 7—7 of FIG. 6;

FIG. 8 is a sectional view taken along line 8—8 of FIG. 6;

FIG. 9 is an isometric view of still another embodiment of a doll hair curler constructed in accordance with this invention;

FIG. 10 is an enlarged sectional view taken along line 10—10 of FIG. 9;

FIG. 11 is a sectional view taken along line 11—11 of FIG. 10;

FIG. 12 is a sectional view taken along line 12—12 of FIG. 10;

FIG. 13 is an isometric view of yet another embodiment of a doll hair curler constructed in accordance with this invention;

FIG. 14 is an enlarged sectional view taken along line 14—14 of FIG. 13;

FIG. 15 is a sectional view of a portion of the embodiment of FIG. 13 shown within the area bounded by the phantom line designated "Fig. 15" of FIG. 14; and FIG. 16 is a sectional view taken along line 16—16 of FIG. 14.

DETAILED DESCRIPTION OF THE PREFERRED EMBODIMENTS

Referring now to the drawing where like reference numerals refer to like parts there is shown at 20A in FIG. 1, a first embodiment of a hair curler for curling the hair of a doll which is constructed in accordance with this invention.

As will be appreciated by those skilled in the art the hair of most commercially available dolls is typically formed of plural fine strands of a synthetic material. In the interests of drawing simplicity these plural strands are not shown. Instead a hank or tress of plural strands of the doll's hair is shown and is designated by the reference number 22. The hank or tress 22 is arranged to be wrapped in a tight spiral of multiple loops about an elongated rod component (to be described hereinafter) of each of the embodiments of the curler of this invention and to have pressure applied thereto by a pressure applicator component (also to be described hereinafter) so that the hairs of the hank take on a curl without the need for the application of heat or steam.

Each of the embodiments of the curlers of this invention comprise the same basic components, namely an elongated rod about which the hank of hair is wrapped, a pressure applicator for applying pressure to the spirally wrapped hank of hair, and a pivotable connecting assembly to enable the elongated rod and pressure applicator to be selectively moved in or out of their operative positions.

In particular, the embodiment 20A includes a rod-like member 24A, a pressure applicator 26A, and a pivotable connecting assembly 28A. The rod-like member 24A is an elongated, linear, cylindrical rod having a very small diameter, e.g., on the order of approximately 0.125 inch (3.2 mm). The member 24A includes a free end 30 in the form of a small ball of slightly larger diameter than the member itself. The ball 30 serves as a safety member to prevent the child playing with the curler from being punctured by the free end of the rod. The opposite end of the member 24A is in the form of a right angled projection or pin 32. The free end of the pin terminates in a truncated cone 34 (for reasons to be described later).

The pressure applicator 26A is an elongated, planar, plate-like member having a pair of rounded ends 36 and 38 and a flange 40 extending the length of the plate between the ends on the underside of the plate. The flange serves to reinforce the plate-like member to give it sufficient ridigity to enable it to apply pressure to the hank of hair as will be described later. A bracket 42 forming a portion of the pivotable connecting assembly 28A projects upward from the top surface of the plate-like member at the end 36. The bracket includes a hole 44 (FIGS. 2 and 3) and a surrounding annular flange 46. The hole 44 is adapted to receive the pin 32 portion of the rod-like member 24 so that it is journalled therein. To that end, as best seen in FIG. 3, the hole 44 includes a tapered entrance way which is slightly larger than the outside diameter of the truncated cone 34 of the pin 32. Thus, the pin can be snap-fit within the hole 44. When so connected the rod-like member 24A is enabled to pivot about the axis 46 of the pin to a closed or "operative" position, such as shown in FIG. 1 wherein it extends parallel to the plate-like member of the pressure applicator 26A. The rod-like member 24A can also pivot to any open position, such as that shown by the exemplary phantom lines in FIG. 1. When the curler's rod-like member 24A is in the open position it is ready to have the hank of hair wrapped about it.

In order to hold the rod-like member 24A in the closed or operative position a catch or hook 48 projects upward from the top surface of the plate-like member at the end 38. The hook 48 is adapted to receive and releasably trap the ball 30 on the free end of the rod-like member 24A as shown in FIGS. 2 and 4 and thus hold the curler in its closed state.

The rod-like member 24A is preferably formed of metal, although it could be formed of plastic or some other suitable material. The pressure applicator 26A and the pivotable connector assembly 28A are preferably formed of plastic, and are preferably molded as an integral or one-piece unit. However, they could form separate components which are secured together. Moreover, each can be of any suitable material, other than plastic.

In order to apply pressure to the spirally wound hank of hair 22 on the rod-like member 24A, the pressure applicator 26A includes a strip of resilient, compressible foam 50 fixedly secured to the top surface of the plate-like member and extending from the upwardly projecting bracket 42 substantially the entire length of the member to a point closely adjacent the hook 48. In accordance with one preferred aspect of the invention the foam includes a pressure sensitive adhesive (not shown) on its undersurface to secure it to the top surface of the plate.

As can be seen clearly in FIGS. 3 and 4 the thickness of the foam strip 50 is such that it substantially fills the space between the upper surface of the plate-like member 26A and the rod-like member 24A, when the rod-like member is in the closed position. Accordingly when a hank of hair is wrapped in a tight spiral about the rod-like member 24A and that member is in the closed position the resilient, compressible foam strip 50 will be compressed somewhat. This action causes the foam strip to apply pressure to the spiral loops of the hank of hair which are interposed between it and the outer surface of the rod-like member 24A. The combination of the tight spiral and the application of pressure ensures that the strands making up the hank of hair take on a curl after a few minutes.

In order to facilitate the curling action of the curler 20A the spirally wound hank of hair 22 may be sprayed or otherwise wetted by the application of water or some other setting medium (not shown) thereto, and allowed to dry. After the hair has dried (if it is wetted) or after sufficient time has elapsed for the curl to be formed, the free end 30 of the curler can be released from the catch 48 by pushing down on it and swinging it out from under the catch. Once the rod-like member is free of the catch it can be moved to an open position relative to the pressure applicator to enable the curled hank of hair to be unwound therefrom.

The second embodiment of the curler of this invention is shown in FIG. 5 and is designated by the reference number 20B. That curler also includes a rod-like member 24B, a pressure applicator 26B, and a pivotable connecting assembly 28B. The rod-like member 24B is an elongated linear cylindrical rod of the same diameter as discussed earlier. The rod-like member 24B includes a free end 30 in the form of a small ball of slightly larger diameter than the member itself. The ball 30 serves the same function as discussed with reference to the curler 20A. The opposite end of the rod-like member 24B is denoted by the reference number 52 and is arranged to be received in a hole (to be described later) in the pivotable connector assembly 28B.

The pressure applicator 26B comprise an elongated rod-like member and a tubular foam member 70. The rod-like member of the pressure applicator is of the same outside diameter as the rod-like member 24B and has a small ball 54 on one end thereof. The other end of the rod-like member of the pressure applicator is in the form of an upstanding hook or catch 56.

A bracket 58 forming a portion of the pivotable connecting assembly 28B is arranged to be pivotally connected to the rod-like member of the pressure applicator 26B. The bracket 58 includes an opening or bore 60 (FIG. 6) into which the end 52 of the rod-like member 24B is fixedly secured. As can best be seen in FIGS. 6 and 7 the bracket is in the form of a yoke having a pair of opposed walls 62 and 64. Each wall has a hole 66 extending therethrough. The holes are axially aligned and form a space 68 between them into which the ball 54 of the rod-like member of the pressure applicator is received for rotation therein. Accordingly, the rod-like member 24B can be pivoted into the closed or operative position shown in FIGS. 5 and 6. The rod-like member can also pivot to any open position, such as that shown by the exemplary phantom lines in FIG. 6.

When the curler's rod-like member 24B is in the open position it is ready to have the hank of hair wrapped about it in the same manner as discussed earlier. The catch or hook-like member 56 serves to hold the rod-like member 24B in the closed position in the same manner as also described earlier.

In order to apply pressure to the spirally wound hank of hair 22 on the rod-like member 24B, the pressure applicator 26B includes the foam tube 70 mentioned earlier. This tube is formed of similar foam to that of the strip 50. The tube 70 includes a central passageway 72 through which the rod-like member of the pressure applicator 26B extends as best seen in FIG. 6. The wall thickness of the foam tube 70 is such that it substantially fills the space between the rod-like member of the pressure applicator 26B extending therethrough and the rod-like member 24B, when that member is in the closed position. Accordingly when a hank of hair is wrapped in a tight spiral about the rod-like member 24B and that member is in the closed position the resilient, compressible foam will be compressed and will apply pressure to the spiral loops of the hank of hair in the same manner as described with reference to curler 20A.

The rod-like member 24B is preferably formed of a plastic, although it could be formed of metal or some other material. The pressure applicator 26B and the pivotable connector assembly 28B are also preferably formed of plastic, but could be formed of other materials. Moreover, the hookunit with the rod-liked as an integral unit with the rod-like member of the pressure applicator 26B.

The third embodiment of the curler of this invention is shown in FIG. 9 and is designated by the reference number 20C. That curler is similar to the embodiment 20D and includes a rod-like member 24C, a pressure applicator 26C, and a pivotable connecting assembly 28C. The curler 20C is preferably formed as an integral unit of any suitable material, e.g., plastic or metal, except for it's foam tube 70. The foam tube 70 forms a part of the pressure applicator 26C and is identical in construction to that described earlier with reference to curler 20B. Thus, as can be seen the rod-like member 24C is an elongated linear cylindrical rod having the same very small diameter, as discussed earlier. The rod-like member includes a linear free end 72. The pressure applicator also comprises an elongated rod-like member having one end in the form of an upstanding catch or hook 74. The hook 74 forms a portion of the pivotable connector assembly 28C. The opposite end of the rod-like member terminates in a helical spring 76, also forming a portion of the pivotable connector assembly. The end of the rod-like member 24C opposite its free end 72 also terminates in the helical spring 76. Thus, the helical spring hingedly connects the rod-like member 24C and the rod-like member of the pressure applicator 26C. The spring is biased so that it tends to pivot the rod-like member 24C outward to the phantom position shown in FIG. 10, from the closed or operative position. In the closed position the free end 72 of the rod-like member 24C is trapped by the catch 74.

In order to apply pressure to the spirally wound hank of hair 22 on the rod-like member 24c, the pressure applicator 26C includes the heretofore identified foam tube 70. The wall thickness of the foam tube 70 is such that it substantially fills the space between the rod-like member of the pressure applicator 26C extending therethrough and the rod-like member 24C, when that member is in the closed position. Accordingly when a hank of hair is wrapped in a tight spiral about the rod-like member 24C and that member is in the closed position the resilient, compressible foam will be compressed and will apply pressure to the spiral loops of the hank of hair in the same manner as described with reference to curlers 20A and 20B.

The fourth embodiment of the curler of this invention is shown in FIG. 13 and is designated by the reference number 20D. That curler is also preferably constructed as an integral unit (like curler 20C), except for the foam strip forming a portion of the pressure applicator 26D. Thus, the curler 20D includes a rod-like member 24D, a pressure applicator 26D, and a pivotable connecting assembly 28D. These members are preferably formed as an integral unit of any suitable material, e.g., plastic.

As best seen in FIGS. 13 and 14 the pressure applicator includes a foam strip 50 like that described with reference to curler 20A. The rod-like member 24C is an elongated linear cylindrical rod also having a very small diameter, like discussed earlier and including a free end 80. The pressure applicator comprises an elongated plate-like member having one end in the form of an upstanding catch or hook 82. The hook 82 forms a portion of the pivotable connector assembly 28D. An elongated rib 84 extends along the length of the plate-like member of the pressure applicator on the bottom surface thereof to strengthen the member for the same reason as discussed with reference to the flange 40 of the curler 20A. The end of the plate-like member of the pressure applicator 26D opposite the catch or hook 82 terminates in a upward projection having a necked down area or channel. This forms a living hinge 86. The living hinge 86 also constitutes a portion of the pivotable connector assembly 28D. The end of the rod-like member 24D opposite its free end 80 flares outward at 88 to terminates at the living hinge 86. Thus, the living hinge pivotally connects the rod-like member 24D and the plate-like member of the pressure applicator 26D. Moreover, the living hinge is biased so that it tends to pivot the rod-like member 24D outward to the position shown in FIG. 15, from the closed or operative position wherein the free end 80 of the rod-like member 24D is trapped by the catch 74.

The foam strip 50 is fixedly secured on the top surface of the plate-like member of the pressure applicator 26C in the same manner as discussed with reference to the curler 20A.

When the curler's rod-like member 24C is in the open position, like that shown in FIG. 15, it is ready to have the hank of hair wrapped about it in the same manner as discussed earlier. The thickness of the foam strip 50 is such that it substantially fills the space between the plate-like member of the pressure applicator 26D and the rod-like member 24D, when that member is in the closed position. Accordingly when a hank of hair is wrapped in a tight spiral about the rod-like member 24C and that member is in the closed position and held in place by the hook 82, the resilient, compressible foam strip will be compressed and will apply pressure to the interposed spiral loops of the hank of hair in the same manner as described with reference to curlers 20A, 20B and 20C.

It should be pointed out at this juncture that while the subject application has particular utility for curling the hair of a doll, which is typically made of a synthetic material, that use is not the only use for the invention. Thus, it is contemplated that the curler and its method of use can be applied to temporarily curl human hair, as well. It should be noted that curling action produced by the subject invention is likely not to be of a permanent type and so that it will over time loose shape and eventually straighten out somewhat. Never the less the subject invention is useful for produce what may be termed an instant (albeit not permanent) curl without requiring the application of heat or steam.

Without further elaboration the foregoing will so fully illustrate my invention that others may, by applying current or future knowledge, adapt the same for use under various conditions of service.

I claim:

1. A curler for curling the hair of a doll, said curler comprising an elongated rod, a pressure applicator, and pivotable connecting means, said rod being arranged to have a hank of the hair of the doll wrapped in a tight spiral configuration along a first portion of the length of said rod, said pressure applicator comprising an elongated rigid member having a pad of a resilient, compressible material mounted on said elongated rigid member to form a hair-engaging surface, said hair engaging surface being of a predetermined width, said first portion of said rod being much smaller in diameter than the predetermined width of said hair-engaging surface, said elongated rod being pivotally connected to said pressure applicator by said pivotable connecting means, whereupon said rod may be releasably disposed in a closed position immediately adjacent and parallel to said hair-engaging surface of said pressure applicator with said pad of resilient compressible material substantially filling the space between said elongated rigid member of said pressure applicator and said rod, said hair engaging surface of said pressure applicator applying pressure to the portion of the hank hair wrapped tightly about said rod and disposed between said pressure applicator and said rod when said rod is in said closed position to thereby cause said hank of hair to take a curl without the necessity of the application of heat thereto.

2. The curler of claim 1 wherein said pivotable connecting means includes a releasable locking member for releasably holding said rod in said closed position.

3. The curler of claim 2 wherein said pivotable connecting means comprises a pivot joint, wherein said releasable locking member comprises a catch, and wherein said elongated rod has a first end forming a portion of said pivot joint and a second free end which is arranged to be releasably engaged by said catch when said rod is in said closed position, said catch being secured to said pressure applicator member.

4. The curler of claim 3 wherein said pivot joint comprises a living hinge.

5. The curler of claim 3 wherein said pivot joint comprises a ball and socket joint.

6. The curler of claim 3 wherein said pivot joint comprises a helical spring.

7. The curler of claim 1 wherein said resilient compressible material comprises a foam.

8. The curler of claim 7 wherein said foam comprises a strip of foam having a pressure sensitive adhesive thereon fixedly securing said strip to said pressure applicator member.

9. The curler of claim 7 wherein said foam comprises a tube and wherein said pressure applicator member extends through said foam tube.

10. The curler of claim 9 wherein said rod, said pressure applicator member and said pivotable connecting means are formed of the same material.

11. The curler of claim 10 wherein said material is a plastic.

12. The curler of claim 10 wherein said rod and said pressure applicator are formed of different materials.

13. The curler of claim 1 wherein said pivotable connecting means comprises a portion forming said elongated rod and a portion forming said pressure applicator member, and wherein said portions are snap-fit together to form a pivotable joint.

14. The curler of claim 13 wherein said portions comprise a ball and a cooperating socket.

15. The curler of claim 13 wherein said portions comprise a circular opening and a cooperating pin.

16. A method of curling hair comprising the steps of:

(1) providing a curler having an elongated rod, a pressure applicator, and pivotable connecting means, said rod being of very small diameter, said pressure applicator an elongated rigid member having a pad of a resilient, compressible material mounted on said elongated rigid member to form a hair-engaging surface, said hair engaging surface being of a predetermined width, said elongated rod having a first portion of a predetermined diameter which is much smaller than said predetermined width of said hair-engaging surface, said elongated rod being pivotally connected to said pressure applicator by said pivotable connecting means between an open position and a closed position and vice versa, said first portion of said rod extending immediately adjacent and parellel to said hair engaging surface of said pressure applicator and with said pad of resilient compressible material substantially filling the space between said elongated rigid member of said pressure applicator and said rod when said rod is in said closed position and being disposed away from said pressure applicator when said rod is in said open position;

(2) manipulating said curler so that said rod into said position;

(3) wrapping a hank of said hair in a tight spiral configuration along said first portion of said rod when said rod is in said open position; and (4) manipulating said curler so that said rod with said spiral hank of hair spirally wrapped thereon is disposed immediately adjacent and parellel to said hair engaging surface of said pressure applicator, whereupon said hair engaging surface of said pressure applicator applies pressure to the portion of the hank of hair disposed between said hair-engaging surface and said rod to cause said hair to take a curl without the necessity of the application of heat thereto.

17. The method of claim 16 additionally comprising the steps of:

(5) manipulating said curler so that said rod is in said open position; and (6) unwrapping said hank of said hair from said rod.

18. The method of claim 16 additionally comprising the step of applying some agent to said hank of hair while said hank of hair is tightly wrapped about said rod and allowing said hank of hair to dry to facilitate the formation of said curl.

19. The method of claim 18 wherein said agent applied is water.

20. The method of claim 18 additionally comprising the steps of:

(5) manipulating said curler so that said rod is in said open position; and (6) unwrapping said hank of said hair from said rod.

21. The method of claim 16 wherein said hank of hair constitutes hair of a doll.

22. The method of claim 21 wherein said hair is synthetic.

* * * * *